US005617654A

United States Patent [19]

Wetta, II

[11] Patent Number: 5,617,654

[45] Date of Patent: Apr. 8, 1997

[54] DREDGE ROTARY CUTTER HEAD

[76] Inventor: William J. Wetta, II, 10001 Tiffany Dr., River Ridge, La. 70123

[21] Appl. No.: 330,750

[22] Filed: Oct. 28, 1994

[51] Int. Cl.[6] ..... A01B 71/04; E02F 3/24; F16C 13/00

[52] U.S. Cl. ..... 37/326; 37/324; 37/327; 37/321; 37/343

[58] Field of Search ..... 37/324, 326, 327, 37/328, 330, 321, 337, 342, 343

[56] References Cited

U.S. PATENT DOCUMENTS

| | | | |
|---|---|---|---|
| 365,140 | 6/1887 | Lynch | 37/327 |
| 526,514 | 9/1894 | Bates | 37/327 |
| 558,188 | 4/1896 | Stevens | 37/326 X |
| 727,691 | 5/1903 | Robinson | 37/327 |
| 1,056,633 | 3/1913 | Curtis et al. | 37/326 |
| 1,477,352 | 12/1923 | Hughes . | |
| 2,040,303 | 5/1936 | Gaylord | 37/327 |
| 2,762,136 | 9/1956 | Bell | 37/326 |
| 2,819,542 | 1/1958 | Stewart et al. | 37/326 X |
| 2,999,324 | 9/1961 | Ohlhausen | 37/67 |
| 3,807,066 | 4/1974 | Proehl | 37/67 |
| 4,135,318 | 1/1979 | Volbeda | 37/67 |
| 4,702,024 | 10/1987 | Shiba et al. | 37/67 |

FOREIGN PATENT DOCUMENTS

| | | | |
|---|---|---|---|
| 008534 | 3/1980 | European Pat. Off. | 37/328 |
| 348363 | of 0000 | France . | |
| 401596 | of 0000 | France . | |
| 57-89035 | 6/1982 | Japan | E02F 3/92 |
| 412350 | 1/1974 | U.S.S.R. . | |
| 382795 | 11/1979 | U.S.S.R. . | |

*Primary Examiner*—Terry Lee Melius
*Assistant Examiner*—Thomas A. Beach
*Attorney, Agent, or Firm*—Pravel, Hewitt, Kimball & Krieger

[57] ABSTRACT

A dredge apparatus with an improved cutter includes a hull, a boom extending from the hull, and a cutter element rotatably mounted at the free end of the boom. The cutter element is positioned adjacent a suction line that is supported by the boom. The improved cutter element includes a plurality of rings having large open central portions for transmitting material to the suction. At least a pair of rings are spaced apart, one of the rings being supported using a rotary hub and spokes to a drive shaft. The external periphery of each of the rings carries three circumferentially spaced helical vanes. The helical vanes extend circumferentially and from ring to ring beginning at a front ring and ending at a rear ring which is adjacent the boom. Each of the vanes is "V-shaped" in transverse cross section providing a concave and a convex vane surface. The concave surface of each vane faces the suction line. The convex surface of each vane faces the front of the cutter element.

7 Claims, 2 Drawing Sheets

DREDGE ROTARY CUTTER HEAD

BACKGROUND OF THE INVENTION

1. Field of the Invention

The present invention relates to dredges and more particularly to cutter elements rotatably disposed upon the end portion of a dredge boom that carries a suction pipe for dredging in a marine environment. Even more particularly, the present invention relates to an improved dredge apparatus and more particularly to an improved rotary cutter element that includes a least a pair of spaced apart circular rings, each having an open center and the pair of rings defining an inlet and an outlet for material to be dredged. The combination of rings define a frame that supports a plurality of helical vanes, each of the vanes extending circumferentially around the rings joining the rings to form a frame therewith and extending from one ring to the next along a helical path, and wherein the rings have a V-shaped transverse cross section providing a concave surface that faces the suction.

2. General Background

Suction dredges are commercially available devices that include a floating barge, an elongated movable boom having a free end and a rotary cutter element or cutter head that is supported at the free end of the boom. The hull portion of the dredge can be held in a fixed position using spuds or anchors or the like. The boom end portion moves with the cutter head to dislodge material that is to be suctioned from the dredge site. The boom typically pivots at its connection to the dredge hull.

Suction dredges have been used to excavate natural material such as is found on river bottoms, lake bottoms and sea beds. However, suction dredges have also been used for clean-up of hazardous waste pits which contain slurried or viscous materials such as for example the refuse of chemical plants, petro-chemical plants, oil and gas well drilling operations and the like. In the clean up of hazardous wastes, the material can be very viscous and difficult to remove using conventional cutter heads and conventional suction dredges.

There exists a need for an improved dredge apparatus including an improved rotary cutter head element that can efficiently remove the viscous material found in hazardous waste dumps and like situations.

Many rotary cutter heads and suction dredges have been patented. Examples of recent patents that relate to cutter heads and suction dredges are U.S. Pat. Nos. 3,807,066; 4,135,318; and 4,702,024. The '066 patent issued to Norman Proehl and entitled "Cutter Head for Suction Dredge" discloses a conical cutting head for use with a suction dredge. The apparatus includes wearing parts and strength members which may be easily assembled and removed for replacement. The cutter head has blades directly attached to strengthening struts with the blades inclined in the direction of rotation of the head. Cutter teeth which extend radially outwardly beyond the blade are also attached directly to the struts. Both the struts and the blades are formed of straight pieces of material of conventional cross sections such as rectangular or square, which have been cut to fit. Lifter plates are provided in the cutter head between the hub and blade to move material to the inlet of the suction mouth.

U.S. Pat. No. 4,135,318 issued to Voldeda provides a generally conical cutter head for an underwater dredger that includes a plurality of helical cutting arms having teeth mounted thereon. The arms are fixed at one end to a hub and at the other end to a base ring. The tooth spacing between the respective cutting arms is arranged in a multi-staggered configuration whereby each tooth removes a symmetrical piece of soil and is not subjected to loads parallel to the local section of the contour line.

U.S. Pat. No. 4,702,024 discloses a dredging helical cutter suited for use for example with a dredger equipped with scope-in plates. Earth and sand is transported by helical vanes to a send-out end portion of helical cutter. The scope-in plates transport the earth and sand to an opening of an earth/sand suction tube. The opening of the suction tube is provided and a portion of the helical cutter for receiving a rotary shaft. All of the earth and sand excavated by the helical cutter can therefore be sucked into the suction tube and the efficiency of the dredging operation can be greatly increased by a simple structure.

Other older patents have issued that relate to cutters and suction dredges. Examples of such older patents include the Hughes U.S. Pat. No. 1,477,352 entitled "Dredge Cutter" providing a spiral blade supporting vanes, a cutting blade secured at the inner surface of each of the vanes and conforming in curvature to the latter, the spiral of the blade being such that it rear travels circumferentially in advance of its forward extremity.

Another older patent is the Olhlahusen U.S. Pat. No. 2,999,324 entitled "Cutters for Hydraulic Dredges". The Olhlahusen patent discloses a cutter comprising a supporting frame including a hub adapted to be rotated about an axis at the center thereof, a plurality of struts extending therefrom and diverging from each other, the ends of the struts being secured to an annular base member, a cutting cage positioned to substantially envelop the frame, the cutting cage including a plurality of annular spaced members being connected by a plurality of web members, said annular members having outwardly extending cutting teeth, the inner portion of said annular members having recessed portions in which said struts of the supporting frame are positioned.

Foreign patents that relate to dredges a cutter heads include French Patent Nos. 401,596 and 348,363; a Japanese Patent No. 57-89035; and Russian Patent Nos. SU412350 and SU382795. The Japanese Patent has a cutter head with multiple rings that include multiple blades between them for rotary dredges. The structure includes an upper cutter and a lower cutter that are connected into a monolithic cutter at a connection an opening end of mud suction pipe inserted into the cutter mounted at the proximity of the connection and the upper and lower cutters rotatably installed at the mud suction pipe. The cutter twistings are formed in a reverse direction to that of the opposite, whereby mud, excavated by the upper cutter, is pushed downward through the rotation of the cutter and mud excavator by the lower cutter is pushed upward through the turning of the center. This permits the smooth operation of the cutter even is a ratio of the length to the diameter of the cutter is set to 1.2 or more.

SUMMARY OF THE INVENTION

The present invention provides an improved rotary dredge or cutter head that has particular utility as a viscous excavator such as for example in the excavation of hazardous waste pits, oil and gas well drilling reserve pits and the like.

The improved dredge apparatus of the present invention includes a hull and a boom extending from the hull and including a boom free end portion. A suction line extends along the boom having a suction inlet adjacent the free end of the boom.

A rotary cutter head is supported on the free end of the boom. A powered drive shaft extends along the boom and communicates with the free end of the boom for rotating the cutter head.

The cutter head is mounted for rotation to the drive shaft. The cutter head includes a least a pair of spaced apart rings each having an open center and a periphery. A hub forms a connection between the rings and the drive shaft, and a plurality of spokes extend from the hub to one of the rings.

A plurality of helical vanes extends from the periphery of one ring to the other ring, each of the vanes extending at least three hundred degrees (300°) around the rings. The vanes rigidly attach to the outer periphery of the rings forming a rigid structure therewith.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
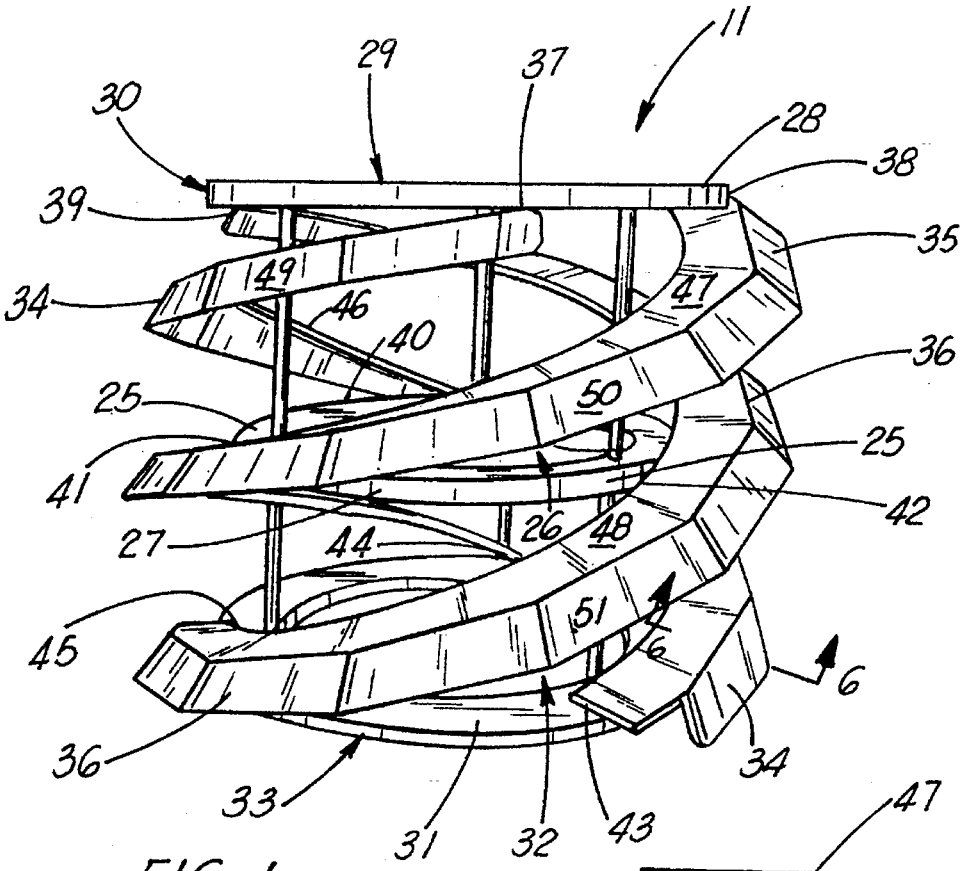
FIG. 1 is a perspective view of the preferred embodiment of the apparatus of the present invention.

FIGS. 1–4 illustrate the preferred embodiment of the apparatus of the present invention designated generally the numeral 10. Dredge apparatus 10 includes a hull 60 having a pivoting boom 12 with a free end 14. The boom 12 and hull 60 can be rigidified using anchors or spuds.

Free end 14 of boom 12 supports dredge cutter head 11. The boom 12 has an elongated suction line 15 with a suction inlet at 15A for receiving material that is dislodged using cutter head 11.

Cutter head 11 is rotatably driven with drive shaft 16 that extends along boom 12. The drive shaft 16 can have a free end portion 17 that receives a bolt for securing drive shaft 16 at end 17 to hub 18. Hub 18 provides an opening 19 that can have a key slot 20 as an example of one way to mount dredge cutter 11 to drive shaft 16 for rotation therewith. A keyway 21 on drive shaft 16 engages slot 20. A plurality of spokes 22–24 extend radially from hub 18 to middle ring 25. In the embodiment of FIGS. 1–6 a plurality of rings are shown including a front ring 28 a rear ring 31 and a middle ring 25.

Each of the rings 25, 28, and 31 includes a central opening. The middle ring 25 has a central opening 26 and a peripheral edge 27. The front ring 28 has a central opening 29 and a peripheral edge 30. The rear ring 31 includes a central opening 32 and a peripheral edge 33.

The plurality of rings 25, 28, 31 define a frame in combination with vanes 34–36. Three vanes 34–36 are helically positioned around the plurality of rings 25, 28, 31 as shown in the drawings. Each of the vanes 34–36 begins with a front attachment to front ring 28, provides an attachment at the mid portion of each vane 34–36 to middle ring 25 and provides a rear attachment to the rear ring at the rear end portion of the particular vane 34–36. In the drawings, the front attachments of the vanes 34–36 respectively are designated by the numeral 37–39. The middle attachments of each vane 34–36 are defined respectively by the numerals 40–42. The numerals 43–45 indicate rear attachments respectively for the vanes 34–36.

Figure 6:
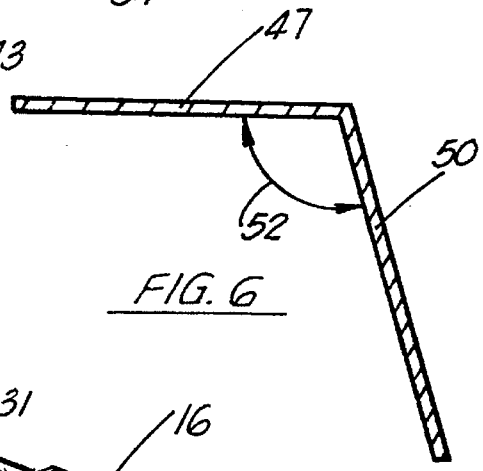
FIG. 6 is a sectional view taken along lines 6—6 of FIG. 1.
Figure 2:
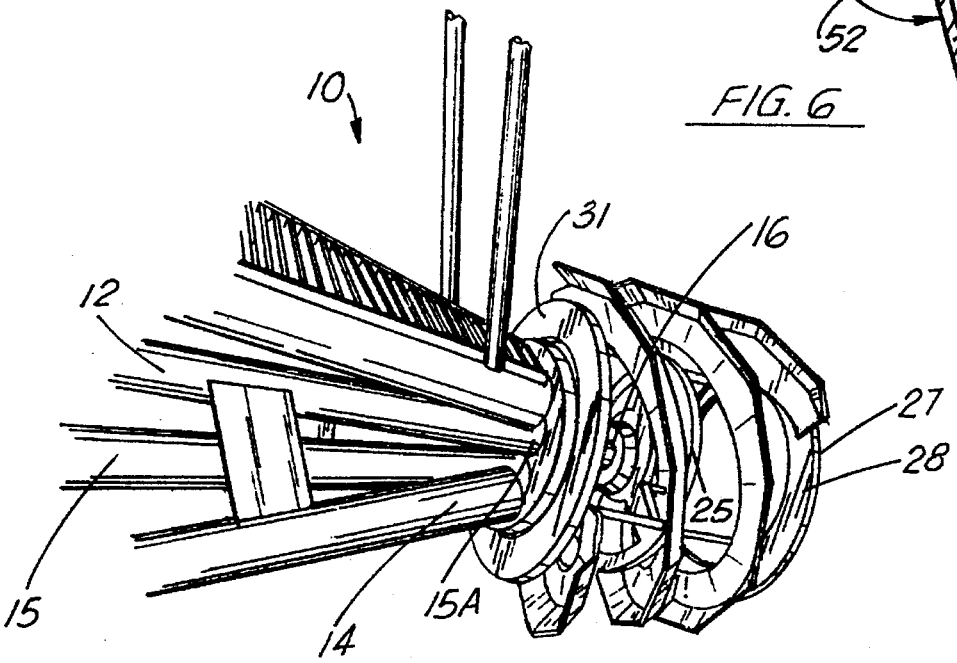
FIG. 2 is a partial perspective view of the preferred embodiment of the apparatus of the present invention.
Figure 3:
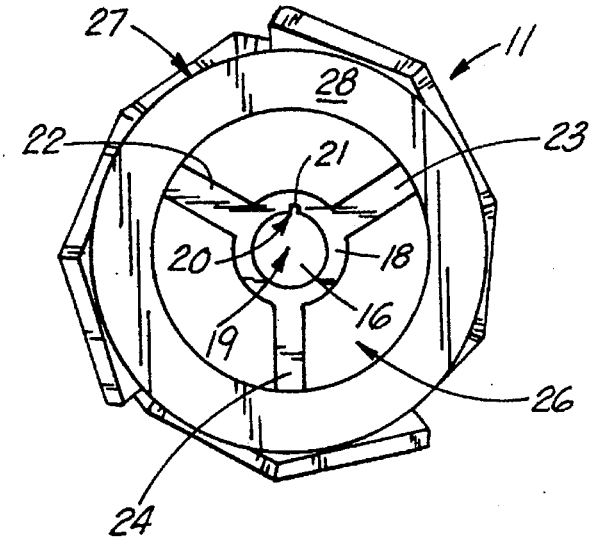
FIG. 3 is a partial end view of the preferred embodiment of the apparatus of the present invention.
Figure 4:
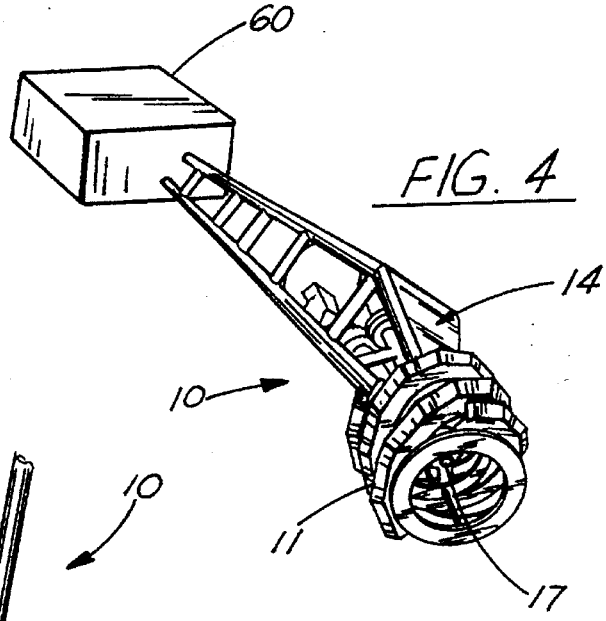
FIG. 4 is a partial perspective frontal end view of the preferred embodiment of the apparatus of the present invention.
Figure 5:
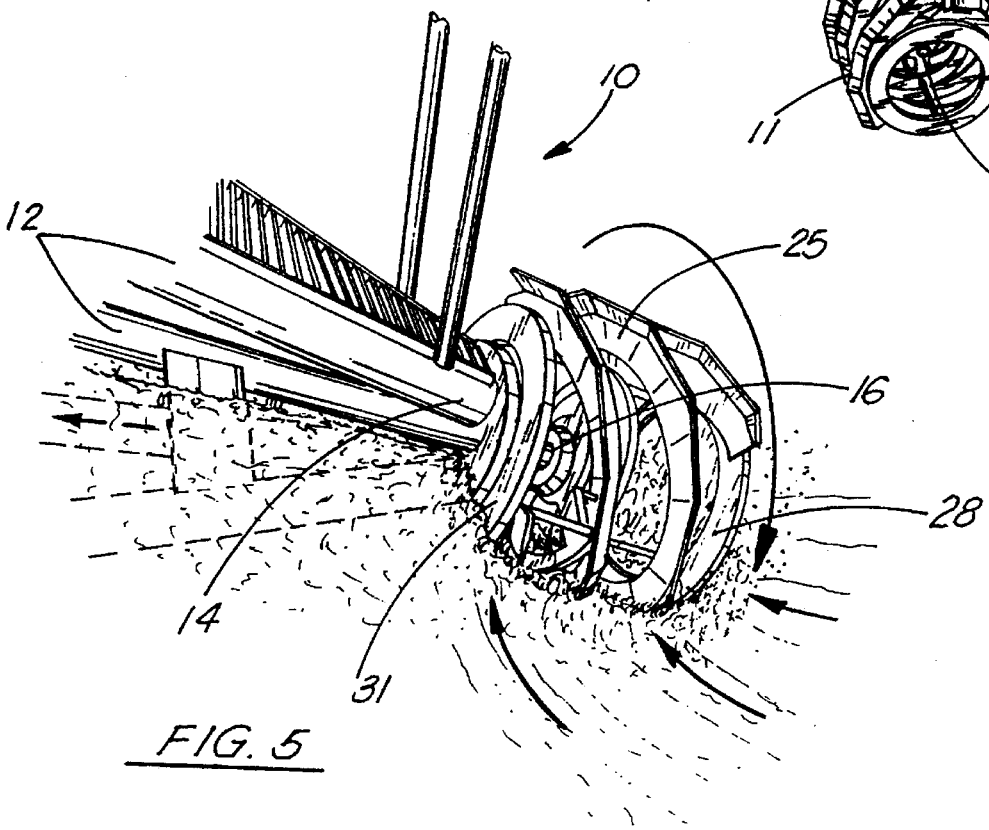
FIG. 5 is a partial perspective side view of the preferred embodiment of the apparatus of the present invention.

Each vane is formed of a pair of flanges including an inner flange and an outer flange. The vane 34 includes an inner flange 46 and an outer flange 49. The vane 35 includes an inner flange 47 and an outer flange 50. The vane 36 includes an inner flange 48 and an outer flange 51. In FIG. 6, angle 52 defines the angle formed between the respective inner flanges 46–48 and outer flanges 49–51.

The following table lists the parts numbers and parts descriptions as used herein and in the drawings attached hereto. The angle 52 between these respective inner and outer flanges is greater than ninety degrees (90°) but less than one hundred and eighty degrees (180°), and preferably between 120° AND 150° degrees.

PARTS LIST

| Part Number | Description |
|---|---|
| 10 | dredge cutter head |
| 11 | cutter head |
| 12 | boom |
| 14 | boom end |
| 15 | suction line |
| 15A | suction inlet |
| 16 | drive shaft |
| 17 | end |
| 18 | hub |
| 19 | opening |
| 20 | key slot |
| 21 | keyway |
| 22 | spoke |
| 23 | spoke |
| 24 | spoke |
| 25 | middle ring |
| 26 | opening |
| 27 | peripheral edge |
| 28 | front ring |
| 29 | opening |
| 30 | peripheral edge |
| 31 | rear ring |
| 32 | opening |
| 33 | peripheral edge |
| 34 | vane |
| 35 | vane |
| 36 | vane |
| 37 | front attachment |
| 38 | front attachment |
| 39 | front attachment |
| 40 | middle attachment |
| 41 | middle attachment |
| 42 | middle attachment |
| 43 | rear attachment |
| 44 | rear attachment |
| 45 | rear attachment |
| 46 | inner flange |
| 47 | inner flange |
| 48 | inner flange |
| 49 | outer flange |
| 50 | outer flange |
| 51 | outer flange |
| 52 | angle |
| 60 | hull. |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A dredge apparatus, comprising:

a) a hull;

b) a boom extending from the hull and including a free end portion;

c) a suction line extending along the boom and having a suction inlet adjacent the free end of the boom;

d) a rotary cutter head supported by the boom;

e) a powered drive shaft supported by the boom for rotating the cutter head;

f) the cutter head including at least a pair of spaced apart, concentric rings, including a front ring and a rear ring, each ring having an open center and a periphery;

g) a hub that is connected to the drive shaft for rotation therewith;

h) a plurality of circumferentially-spaced spokes extending radially from the hub to one of the rings; and i) three helical vanes, the helical vanes including vane end portions, mounted entirely between the front and rear rings, each vane extending from the periphery of the front ring to the periphery of the rear ring, each of the vanes extending at least three hundred (300) degrees around the rings and being attached to each ring, wherein each of the helical vanes is V-shaped in transverse cross section, the vanes each comprising first and second intersecting vane panels that intersect at an angle of greater than 90 degrees and less than 180 degrees, and the vanes are spaced circumferentially about one hundred twenty degrees apart.

2. The dredge apparatus of claim 1 wherein there are three rings.

3. The dredge apparatus of claim 1 wherein each of the rings has an open center that is at least 12 inches in diameter.

4. The dredge apparatus of claim 1 wherein each of the rings has an open center having a diameter of between 12 and 30 inches.

5. The apparatus of claim 1 wherein each of the vanes extends about 300–380 degrees around the periphery of the rings.

6. The apparatus of claim 1 wherein the vanes each comprise first and second intersecting vane panels that intersect at an angle of between about 120 and 150 degrees.

7. The apparatus of claim 1 wherein each of the vanes attaches to each of rings at one point of attachment.

* * * * *